United States Patent [19]

Ellis, Jr.

[11] Patent Number: 4,695,838

[45] Date of Patent: Sep. 22, 1987

[54] PLASMA PANEL DISPLAY SELECTIVELY UPDATABLE ON PEL LINE BASIS

[75] Inventor: Joseph J. Ellis, Jr., West Hurley, N.Y.

[73] Assignee: International Business Machines Corporation, Armonk, N.Y.

[21] Appl. No.: 729,013

[22] Filed: Apr. 30, 1985

[51] Int. Cl.[4] ..... G09G 3/28

[52] U.S. Cl. ..... 340/771; 340/798; 340/799

[58] Field of Search ..... 340/758, 771, 772, 774, 340/776, 798, 799, 803, 784, 744, 750, 800

[56] References Cited

U.S. PATENT DOCUMENTS

| | | | |
|---|---|---|---|
| 4,087,806 | 5/1978 | Miller | 340/771 |
| 4,200,868 | 8/1980 | Lamoureux et al. | 340/771 X |
| 4,247,856 | 1/1981 | Fumeron | 340/771 |
| 4,364,080 | 12/1982 | Vidovic | 340/799 X |
| 4,485,378 | 11/1984 | Matsui et al. | 340/798 X |
| 4,486,856 | 12/1984 | Heckel et al. | 340/799 X |
| 4,546,350 | 10/1985 | Tanake | 340/744 X |

OTHER PUBLICATIONS

IBM 581 OEM Display Subassembly Product Description—Fourth Edition (Aug., 1984); IBM Publication No. SC27-0651-3; Copyright International Business Machines Corporation 1982, 1983, 1984.

*Primary Examiner*—Gerald L. Brigance
*Attorney, Agent, or Firm*—Joseph J. Connerton; Frederick D. Poag

[57] ABSTRACT

A display system is disclosed comprising a processor, a plasma panel subassembly including generally orthogonally related arrays of conductors and drive circuits for the same, and a read-write memory for storing the image data provided by the processor and delivering drive information to the panel subassembly. Control logic provides arbitration for time sharing the operation of the memory between communication with the processor and with the panel subassembly, storage of modified data tags means associated with the memory operation, and means under the control of the modified data tag means to control update erase and write operations of the panel subassembly on an as-needed individual pel line basis.

4 Claims, 6 Drawing Figures

NOTE: PC $A_{\emptyset}$ STEER DATA BYTE
$A_{16} - A_1$ ADDRESS MEMORY

PLASMA PANEL DISPLAY SELECTIVELY UPDATABLE ON PEL LINE BASIS

BACKGROUND OF THE INVENTION

1. Field of the Invention

This invention relates to panel displays having pel storage capability, and more particularly to a plasma panel graphics apparatus having means for updating the pel array to be shown, accurately and on a substantially real time basis.

2. Prior Art

The prior art includes numerous examples of plasma (or "gas") panel displays having selective write and erase circuits. An example is seen in U.S. Pat. No. 3,851,211. It is possible to use such prior art means to provide an all point addressable graphic display, but the burden on the data source, such as a processor, is considerable and the update rate of the image can be lower than desired for a dynamic graphic display.

Display update rates can be speeded by prior art systems which erase and rewrite the display a swath at a time, and the load on the source processor can be reduced by interposing a row buffer and a character generator between the processor and the panel assembly. Modified data tags can be used to further reduce the processing time.

3. Summary of the Invention

It is a primary object of the invention to provide a plasma panel display apparatus in which the erase-write interface to the panel subassembly is operated at its maximum data rate, while minimizing the overhead on the system processor.

According to one aspect of the invention, there is provided in a display system comprising a processor, a plasma panel subassembly including generally orthoganally related arrays of conductors and drive circuits for the same, and a read-write memory for storing the image data provided by the processor and delivering drive information to the panel subassembly, control logic for time sharing the operation of the memory between communication with the processor and with the panel subassembly, modified data tags means associated with the memory operation, and means under the control of the modified data tag means to control update, erase and write operations of the panel subassembly on an as-needed individual pel line basis.

According to another aspect of the invention, the modified data tag means are provided in memory-associated and copy registers, means are provided to scan the tag means repetitively and to freeze the status of the copy register upon a change in the content of the memory-associated register, and means are provided to carry out the erase and write operations under the control of the copy register.

According to still another aspect of the invention, there is provided a plasma display having a pel defining conductor array comprising groups of lines and line group erase means to erase (extinguish) pels of a given group in a single operation, there being means to provide a modified data tag for each line in a group containing a pel which is to be erased and means responsive to the modified data tag means to activate the line group erase means only with respect to those lines of the group which includes pels to be erased.

Other objects and advantages of the invention will be apparent from the specification and the drawings forming a part thereof.

DETAILED DESCRIPTION

Figure 1:
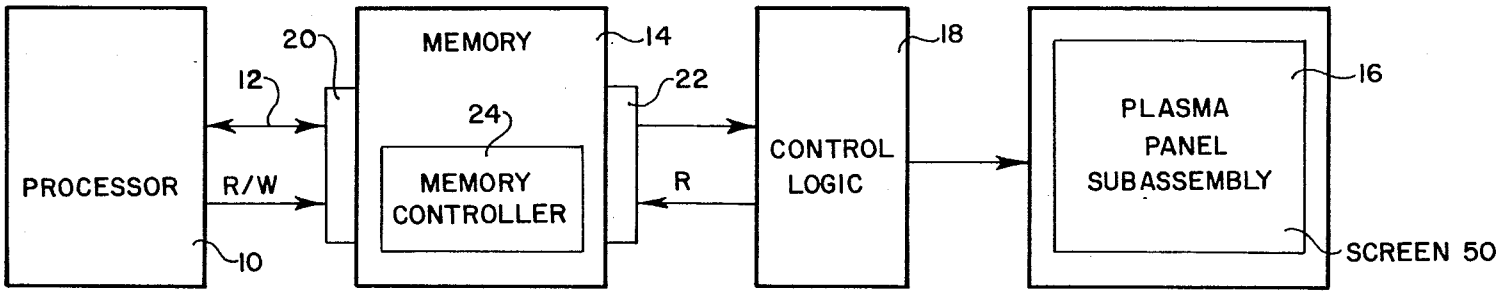
FIG. 1 shows a processor driven plasma panel display system embodying the invention.

The system arrangement shown in FIG. 1 includes a processor 10 which may, typically, include a personal computer such as an IBM Personal Computer XT and, optionally, a control module by which data generated by the computer is supplied by a line 12 to a dual ported memory organization 14. As will be set forth in greater detail with reference to other figures, memory 14 includes a mapped memory buffer portion which contains the bit image of the pels to be displayed by a plasma panel subassembly 16. The logic control 18, which together with elements of the memory 14, acts in accordance with the invention to provide selective updates of the panel image shown on the screen of the panel plasma subassembly 16.

The bit image storage in the mapped memory can be similar to that seen in prior art cathode ray tube raster display systems. Accordingly, various commercially available data-to-raster conversion modules can be used in conjunction with the personal computer to form the processor 10, or the personal computer itself can be programmed to perform this function. The plasma panel subassembly 16 may be an IBM 581 plasma display subassembly described in a publication entitled "IBM 581 Plasma Display Subassembly OEM Product Description", Fourth Edition (August, 1984), Copyright International Business Machines Corporation 1982, 1983, 1984, Publication number SC27-0651-3. Since the structure and principles of operation of this element are well-known, it will not be described in detail. The physical description, interface, logical organization and operations and typical user attachments are described in that publication.

Figure 2:
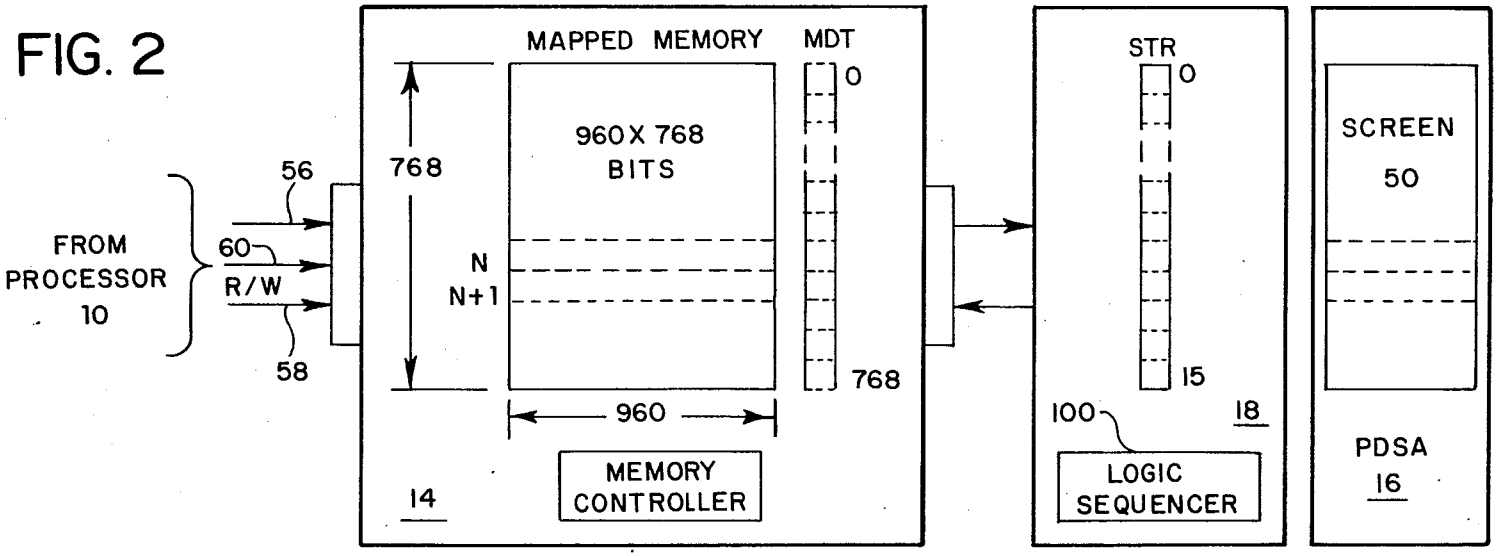
FIG. 2 is a schematic diagram useful in explaining operation of the system of FIG. 1 in the updating of a given pel in the plasma panel display.

FIG. 2 shows the general data flow and scheme of operation in accordance with the invention. Details of the physical equipment will be described later with reference to FIGS. 3 and 4. The processor 10 acts as a source of data to be loaded into a buffer portion of memory 14 which is, as aforesaid, mapped pel for pel with the image to be displayed on the screen of the plasma panel 16. Any source could be utilized, but it is convenient to use a personal computer and, optionally, a controller module in processor 10 as aforesaid, because these are commercially available items and can easily be used to load the mapped buffer in memory 16 in the same fashion that a cathode ray tube refresh buffer could be loaded, including the use of such facilities of vector to raster converters which are well known and available in such personal computer-CRTC module combinations. Accordingly, it is a straight forward matter to load a desired graphical "image" into the mapped buffer of memory 14 through its port 20 by which it communicates with processor 10. Assuming a display panel size of 960 pels (960 X lines) wide, and 768 pels (768 Y lines) high, it is convenient to use a 1024×768 bit memory which accommodates the displayable pel data with 64×768 bits left over.

In accordance with the preferred embodiment of the invention, storage of an additional module space is provided as a register area of 768 by 1 bits to constitute a first modified data tag (MDT) register. This portion of the memory has one bit of storage for each horizontal line of pels represented in the mapped buffer and is accessed by the high order bits of the address applied to memory 14 by processor 10 during a write operation so as to record a "1" bit in a corresponding bit location when any write operation is applied to the mapped memory buffer with the corresponding high order address. Thus, the write operation such as write "0" is applied to some location in row N of the mapped buffer, then at position N of the modified data tag register, a "1" bit is recorded, and if a write "1" operation is applied to any location in the next row N+1 of the mapped buffer, a "1" bit is again written into the modified tag register, in this case at position N+1. It should be noted that the bites recorded in the modified data tag register indicate only that a write operation has been made in a segment of the mapped buffer corresponding to a given pel row or line in the plasma panel. It does not matter whether the write operation is the writing of a "0" which will result in erasing a pel in the ultimate image or is a writing of a "1" which will result in writing a pel.

The memory 14 is a so called "dual ported" memory in which one port 20 communicates with the processor 10 and the other port 22 is readable by the control logic 18. The memory controller 24, which could be for example an Intel 8203 memory controller, responds to signals from the control logic 18 to provide multiplexing of the operations of the dual ports 20 and 22 in a non-conflicting manner. The logic 18 operates to repetitively scan the modified data tag register MDT in memory 14, in groups of 16 bits corresponding to the groups of 16 Y lines each of which constitutes a horizontal swath across the display panel in subassembly 16. This information is transferred to a second modified data tag register STR in the control logic 18 which operates as a mask under which the data from the row thus selected in the mapped memory is effectively transferred to the plasma panel display in the subassembly 16. Since this transfer is under mask, only the lines of the display requiring updating are subjected to an erase and subsequent write operation and therefore, the update of the entire display panel is accomplish in a minimum time.

The search algorithm is as follows: The control logic 18 steps sequentially through the modified data tag register MDT in segments corresponding to the Y groups from the top of the display panel to the bottom. All 16 tags for a given Y group are read to a swath tag register STR in the logic 18 and processed as a unit. If none of the tags is set, the logic proceeds sequentially to the next Y groups. If any of the tags in a group is set, all display lines of that group with active tags are simultaneously erased, and then the tagged lines of that swath are rewritten with data from the mapped memory.

FIG. 2 illustrates this operation. Let it be assumed that the plasma panel or screen 50 in subassembly 16 has a bit or pel in the ON or illuminated condition in line N and a non-illuminated pel position in line N+1, and it is desired to extinguish the pel at 52 and to illuminate one at 54. To accomplish this, the source, such as the processor 10 of FIG. 1, supplies the address of the position in terms of 17 bits on address bus 56 together with a write command on line 58 and a byte including the "0" data bit on data line 60. This results in the writing of a zero bit in the mapped memory and because of the high order address of line N has been utilized to effect this writing operation, a "1" bit will be written in MDT at its Nth bit position as shown at 56. In like manner, in order to eventually cause the illumination of a selected pel on the panel 50, the processor will write a byte including the "1" bit at a corresponding position in the mapped memory and the high order address of that position will be utilized to write a "1" in N+1 position of MDT at 58.

In the foregoing illustration, if lines N and N+1 are in the same 16 line swath, the erase operations with respect to them are conducted as a group, and if no other lines in that swath have been changed (i.e. if there have been no write operations to any of the other lines in that swath) then no other lines in that swath need be rewritten. Therefore, the STR register is again used in effect as a mask register, to limit the rewriting of the panel lines to only those which are tagged.

The STR register in logic 18 constitutes copy of the modified data tag register MDT and operates as a mask under which erase and rewrite operations of a 16 line swath of the gas panel can be executed. Upon detection of an active MDT bit, further scanning of MDT is halted and the logic 18 enters the update mode. An erase operation of a 16 line swath, generally as described in the referenced publication, is executed, but in accordance with the present invention, this erase operation is under mask STR whereby only the 2 lines in which the pel positions are resident are erased. Then a write operation is instituted again using the mask STR again to restrict the writing operation to only those horizontal lines corresponding to the positions marked by "1" bit by the MDT register. The corresponding MDT bits are then cleared as each line is copied to the display and scanning of the MDT register is continued for the next 16 bit segment corresponding to the next 16 lines of the plasma panel.

Figure 3A:
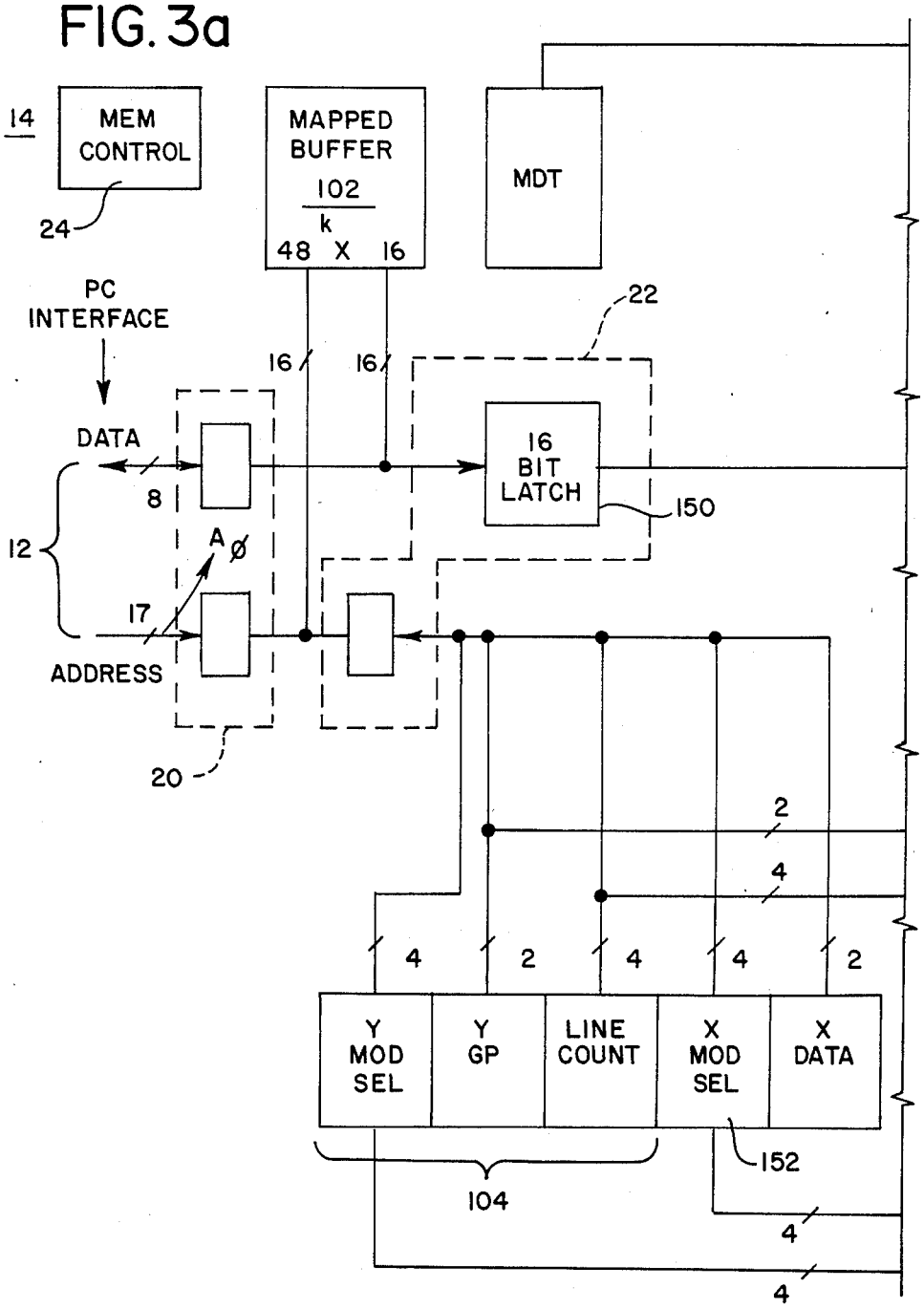
FIGS. 3*a* and 3*b* are a logic diagram showing apparatus for providing data flow as illustrated schematically in FIG. 2.
Figure 3B:
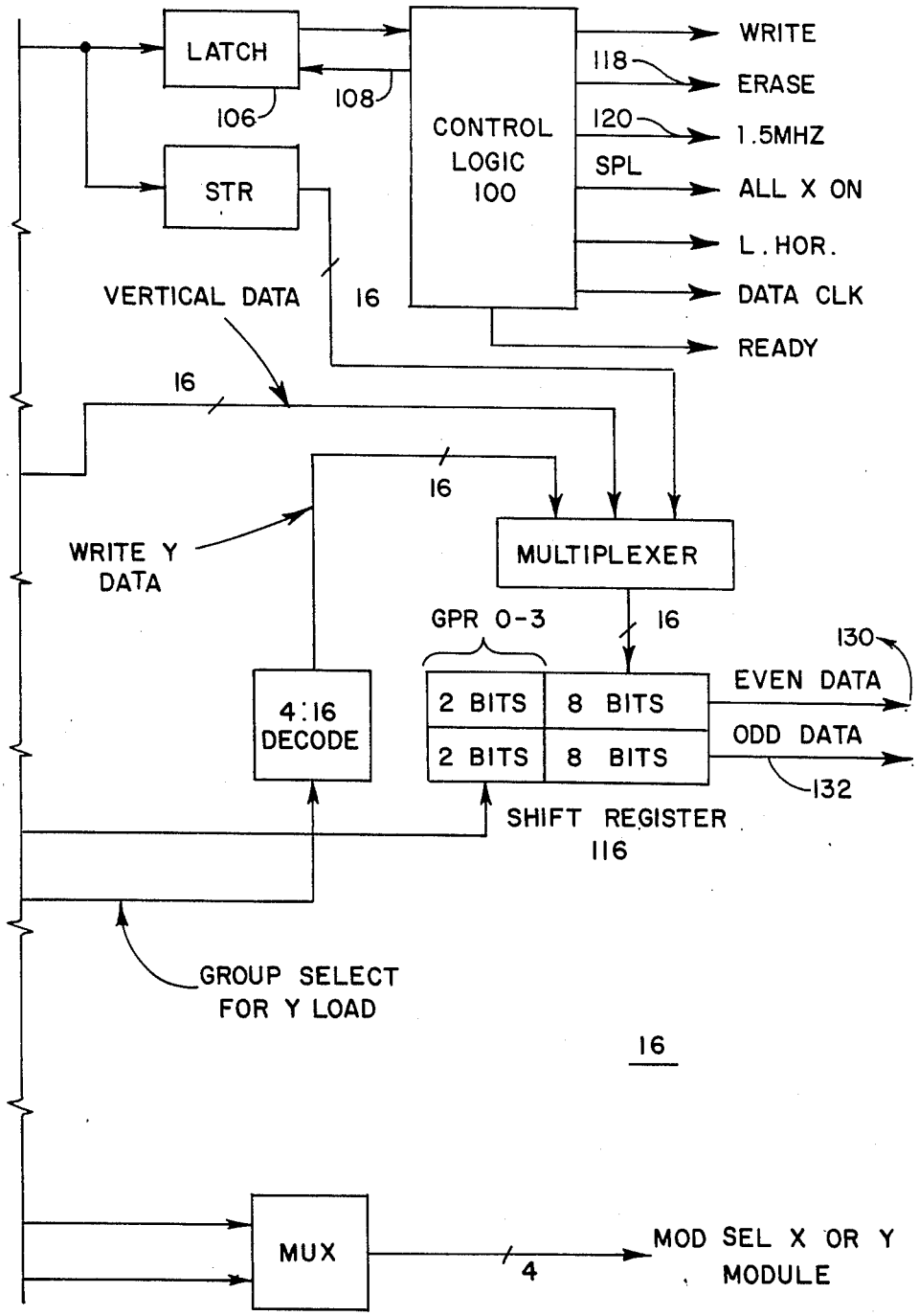

The aforedescribed operation lends itself to hardware implementation for simplicity and speed of panel updating. FIG. 3 shows a schematic of a preferred embodiment of such hardware logic. Since the addressing for the mapped buffer is directly related to the panel screen coordinates the control logic can be implemented readily using either a VTL or a VLSI gate array. To simplify the figure, most of the control lines are omitted.

The mapped buffer 102 can be written to or read from by the processor (FIG. 1) on a demand basis at any time except during operations through the other port 22 of the memory 14. When data is written in buffer 102, the high order portion of the address, i.e. the pel line number, sets a bit in the modified data tag portion MDT of the memory 14. Processor memory requests are given the higher priority, as compared to the control 18, so as to minimize the time required to update the mapped buffer.

At other times, the control is constantly accessing the memory via its port 22 and a Y address counter 104 to maintain a copy of successive 16 bit segments of the MDT control in the swath tag register STR. This is referred to as State 0.

State 0:

During State 0, the input to STR is monitored by a latch 106 which is set to yield a signal on its output 108 when a "1" bit is read from the MDT. The control logic 100 responds to a signal on line 108 to stop the operation of the counter 104 on the next 16-line boundary, thereby capturing in register STR a picture of the bit pattern in the MDT of the line group just scanned.

The control logic 100 then enters State 1 if it is not in write only mode (used to overlay two images on the display).

State 1:

In State 1, the control logic 100 performs a Load Horizontal operation to the shift register 116. All scan lines (i.e. Y lines) with active tags in the STR will be selected. The Y Module Select and Group are defined by the high order address bits in coreater 104 which identify the Y group which gave rise to the tag bits in the STR. Since this Y Load is for the erasure of complete scan line(s), the PDSA 16 Set Panel Line is also activated. Upon completion of the Y Load, the control logic steps to State 2. The modules referred to are seen at 140 in FIG. 5. Each module pair drives 64 lines (four, 16 line groups).

State 2:

At this time the control logic 100 generates a PDSA 18 erase pulse (line 118) synchronized to the 1.5 MHz 120 clock and then control passes to State 3.

State 3:

The control logic 100 now performs a Y Load for the next scan line to be written. The number of times the logic must pass through State 3 is equal to the number of tags set in the Y Group (1 to 16) as recorded in the STR. It should be noted that State 3 is identical to State 1, except that the Set Set Panel Line is not activated. Upon completing State 3 the control logic steps to State 4.

State 4:

At this time the adapter will load one X Module driver pair via latch 150 and upon completion of the load increment the X Module Select counter 152. The memory cycle time is such that the X data is transferred at 6 MBPs independent of refresh or system accesses to the buffer. The control logic then passes control to State 5.

State 5:

At this point the logic tests the X Module Select address to determine if the current scan line is complete. If all X driver modules have not been loaded, the adapter branches back to State 4; otherwise the logic steps to State 6.

State 6:

A write pulse synchronized to the 1.5 MHz clock is generated at this time. The logic also tests to determine if the last active tag within the group has been updated. If all tags have been serviced the logic clears latch 106 and branches to State 0: otherwise, control is passed to State 3.

Since the MDT bits are set by memory writes from the processor interface (port 20) and reset by memory reads from the control logic 18 (port 22), the control logic can determine which group(s) have been updated by interrogating the MDT in memory. To guarantee that in steady state the screen will be an exact copy of the mapped buffer, the control logic resets a tag in the MDT at the start of each raster line update. However, the tags are preserved in the STR until the group update is complete.

Figure 4:
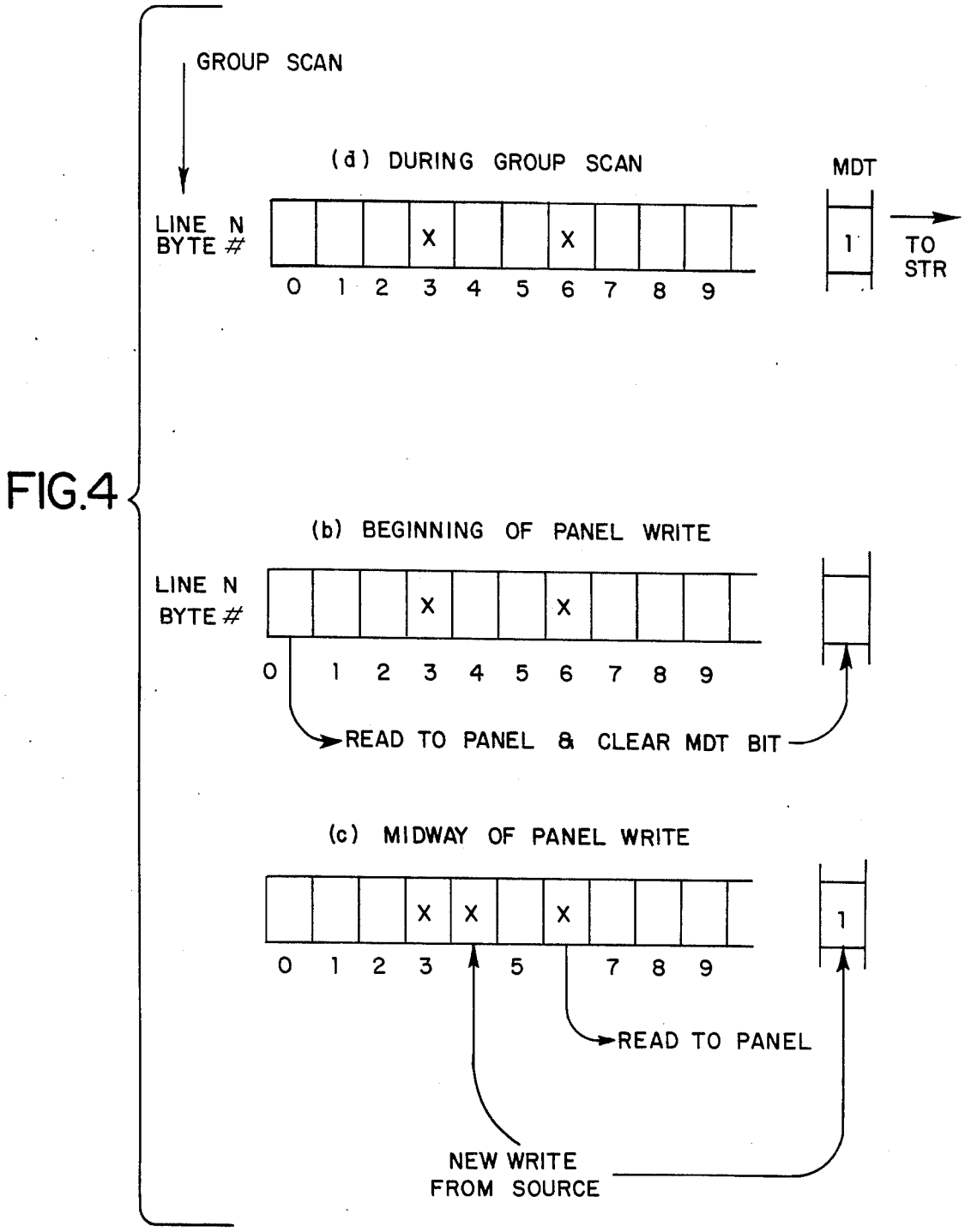
FIG. 4 is a diagram illustrative of operations in the apparatus of FIGS. 3*a* and 3*b*.

FIG. 4 shows relationships between source 10 memory writes, control logic 18 reads at panel write time and MDT resets. In diagram (a) line N has previously existing changes in bytes 3 and 6 as the result of write(s) from source 10. Accordingly, the MDT bit for line N has been set. In diagram (b) the logic 18 has just begun to fetch all of the bytes of lines N, starting in any event with the first byte (whether new or old). The MDT bit position for line N is immediately cleared at this time. In diagram (c), the logic 18 is reading byte 6 to the panel and the source has meanwhile altered 4 by a new write. This sets the MDT position corresponding to line N but this position of the MDT will not be read to the STR until the next state 0, i.e. the next scan of the MDT group which contains line N. It should be noted that if the new write had been to byte 8, for example, it would have been effective in this panel line re-write cycle and that update would be repeated in the next cycle, so that there can be redundancy in re-writes. However, by "shutting off" attention further to the MDT immediately after reading byte 0, there can never be a time that a change in the mapped buffer goes untransferred to the panel.

Figure 5:
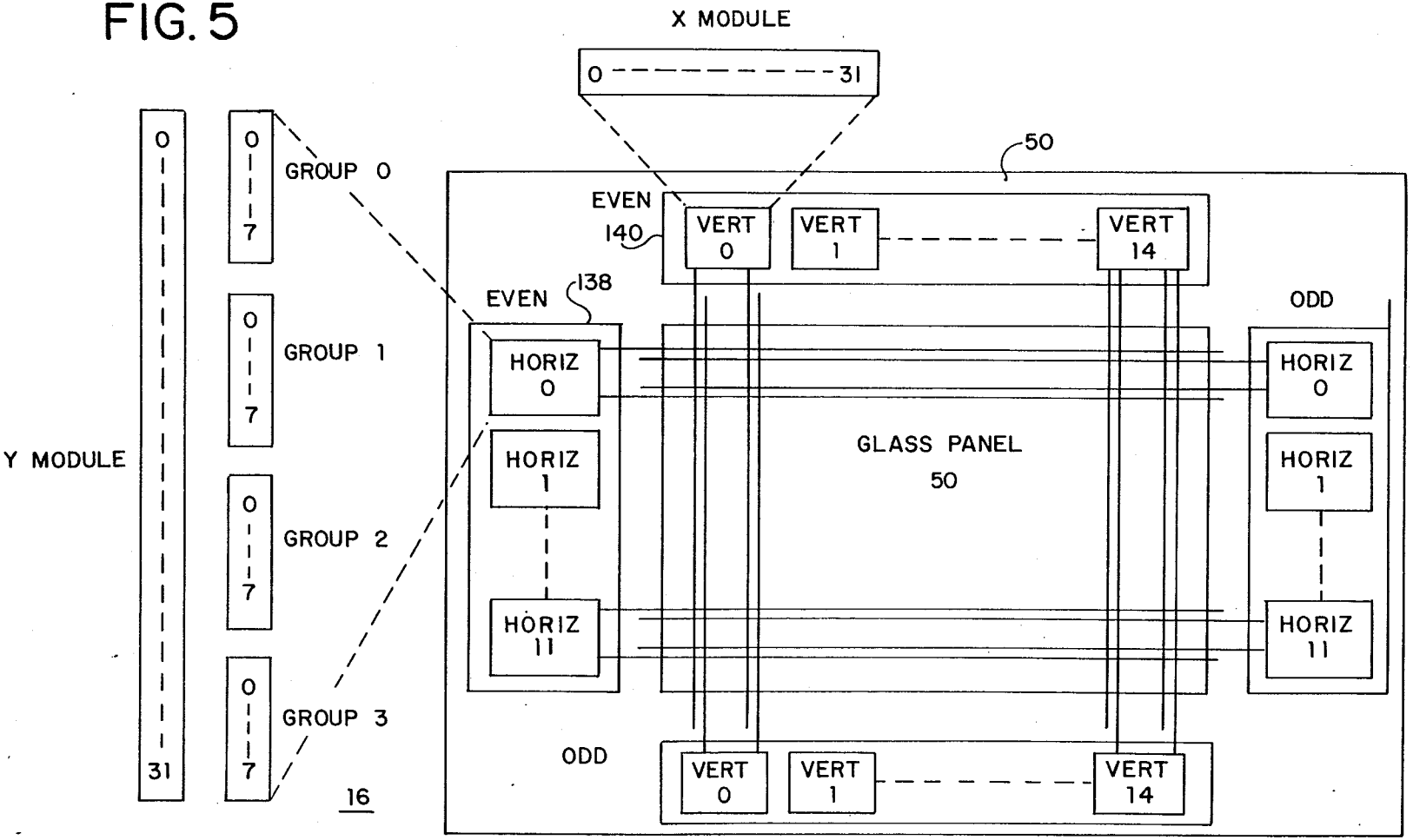
FIG. 5 illustrates a plasma panel structure suitable for employment in the system of FIG. 1.

FIG. 5 shows the relationship of the horizontal (Y) and vertical (X) conductor control modules to the plasma panel. In the illustrated structure, the panel conductors are physically interleaved and driven from opposite edges compactness, but they are electrically grouped for horizontal swath update as aforedescribed.

What is claimed is:

1. A display system comprising:

a processor, a plasma display panel assembly including generally orthogonally related conductor arrays and drive circuits for each conductor in said arrays, control logic and a read-write memory for storing image data from said processor and delivering drive information to the said plasma panel assembly, said control logic being adapted for time sharing said read-write memory between said processor and said plasma display panel assembly, means for providing a plurality of data tags associated with the operation of said read-write memory to identify data changes to be displayed, each line of said display having an associated data tag, means for modifying said data tags to identify data lines to be updated, and control means responsive to said modified data tags to control update, erase and write operations on said plasma display panel assembly on an individual line basis.

2. A system in accordance with claim 1 further comprising means for storing modified data tags in memory associated and copy registers, means to scan said data tags repetitively and to freeze the status of said copy registers upon a change in the content of said memory associated and copy registers, and means to carry out the erase and write operations as determined by the contents of said copy register.

3. A plasma display system having a pair of pel defining conductor arrays, said plasma display system comprising groups of lines and associated group erase means to simultaneously erase pels of a selected group of lines in a single operation, a data tag associated with each line in said selected group of lines to be erased, means for modifying the data tag associated with each line in said selected line group containing a pel to be erased and control means responsive to said modified data tags to activate the line group erase means only with respect to those lines of the group which include a modified data tag whereby erase and update operations in said plasma display system are controlled on a line group basis.

4. A plasma display in accordance with claim 3 further including a control means comprising a first register for storing lines to be updated and a second register to maintain a copy of said first register for a subsequent line-by-line rewrite of said plasma display panel, and means to reset the data tags in said first register as soon as rewriting of the corresponding line of the display is initiated.

* * * * *